United States Patent [19]

Knudson

[11] Patent Number: 4,519,334

[45] Date of Patent: May 28, 1985

[54] STEERING CONTROLLERS FOR BOATS

[75] Inventor: Giltner J. Knudson, Costa Mesa, Calif.

[73] Assignee: Nancy K. Hutchinson, Newport Beach, Calif.

[21] Appl. No.: 477,774

[22] Filed: Mar. 22, 1983

[51] Int. Cl.[3] ..... B63H 25/04

[52] U.S. Cl. ..... 114/144 R; 114/144 E

[58] Field of Search ..... 114/144 E, 144 R; 74/25, 37

[56] References Cited

U.S. PATENT DOCUMENTS 372,691 11/1887 Lombard ..... 114/150

1,811,578 6/1931 Florisson ..... 74/25

2,864,990 12/1958 Hill ..... 114/144 R 3,237,583 3/1966 Johnson ..... 114/144 R

*Primary Examiner*—Sherman D. Basinger

*Attorney, Agent, or Firm*—Grover A. Frater

[57] ABSTRACT

An improved automatic steering controller for boats employs an adjustable feedback link between the output element and feedback elements of the system. A preferred form employs a lever arrangement in which the feedback ratio is varied by varying the lever arm to connections from the lever to one or the other, or both, of the output element and feedback element. The lever is related to the feedback element in a way that facilitates reversal of feedback element movement whereby to permit steering control from either side, port or starboard, of a tiller or wheel.

2 Claims, 4 Drawing Figures

STEERING CONTROLLERS FOR BOATS

TECHNICAL FIELD

This invention relates to improvements in automatic steering systems for boats.

BACKGROUND ART

Tending the tiller or wheel of a boat, even a small one, can be a boring and tiresome job. To alleviate that situation, a variety of automatic steering control systems have been devised. They all include some means for establishing a desired course heading, and they include a direction sensing device.

Early automatic steering systems were developed for larger vessels in servo-mechanism form. The feedback systems were quite complex and costly. In any event, they were too complex and costly for use on smaller boats.

The current standard for small boats is a simple servo-mechanism. One of the most popular and successful, at least for direct control of the tiller, is a servo-mechanism whose error detector includes a compass whose card is mounted for rotation in a compass case which is itself mounted for rotation relative to the vessel's heading. The compass card is opaque over half of its area or circumference and clear or reflective over the other half. A sensor mounted for rotation with the compass case relative to the card distinguishes opaque from reflective or transparent.

Such a compass construction simplifies introduction of feedback signals because it is required only to rotate the compass case to move the sensor while the rudder is positioned to hold the boat on the desired course. A leading tiller controller is arranged so that the sensor is moved manually relative to a magnetic heading defined as the dividing line between the transparent and the opaque portion of the compass card. The compass case, and therefore the sensor, is moved relative to the compass card as the boat turns to the desired heading.

The output element of the mechanism is an apparatus which moves to move the rudder. The feedback circuit is arranged such that movement of the output element moves the sensor relative to the card. Such a servo-mechanism can be made in very simple and reliable form. Easily placed in operation and removed, it is a very convenient apparatus. Unfortunately, the degree of rudder movement and the interval over which heading correction is accomplished varies greatly. These handling characteristics vary with hull length and design and rigging and weight, and with keel design and other factors.

Each boat design dictates a different degree of feedback or "stiffness" in the servo-mechanism design. The error signal in the simple system does not vary in proportion to magnitude of error. It has one value for error to port, another for zero error, and the third for error to starboard. Changing the feedback factor electrically is possible, but costly. Conventional systems employ a system of pulleys or gears or travelling nuts and the like in moving the output and feedback elements. The degree of feedback the ratio of feedback element movement to output element movement is made a function of pulley or gear size and is changed by changing size.

That gives rise to three major problems. The first arises because it is difficult in such a structure to make the steering device equally applicable to steering from starboard or port of the tiller or wheel. The second is that distribution and sale of such automatic steering devices is made difficult by the need to install a pulley that most nearly matches the handling characteristics of the boat in most conditions. The third problem is that there is no convenient way to alter the degree of feedback to meet changing conditions. Changing the degree of feedback requires changing pulleys.

DISCLOSURE OF INVENTION

An object of the invention is to provide an improved automatic boat steering controller.

Another object is to provide, by minimum modification, for improved performance in existing automatic controller designs.

Another object is to provide an inexpensive, removeable automatic boat steering controller in which the feedback factor is easily adjusted to accommodate different boat handling characteristics.

In the preferred embodiment, these and other objects and advantages of the invention are realized, in part, by the incorporation of a lever system in the feedback system, the movement of which by the output element of the controller results in movement of the feedback element. Changing the feedback factor then involves only changing the length of the lever arm by changing the point at which one or both of the output element and feedback element are connected to the lever.

DESCRIPTION OF THE PREFERRED EMBODIMENT

Figure 3:
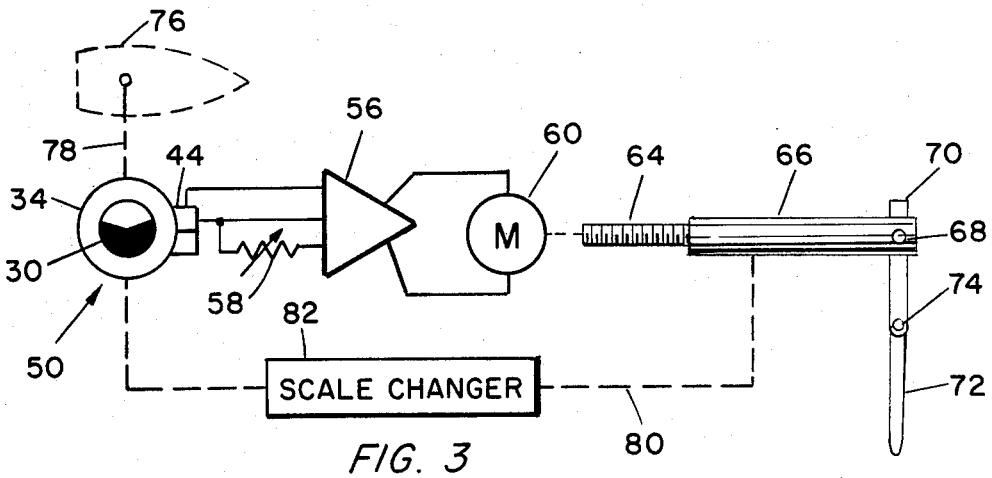
FIG. 3 is a schematic diagram of a controller which embodies the invention.
Figure 4:
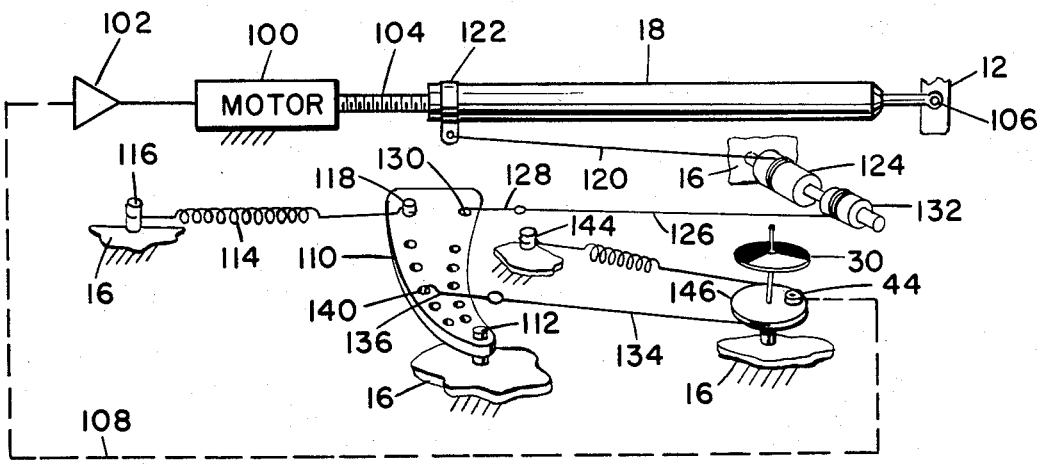
FIG. 4 is a partly schematic and partly diagramatic representation of the controller of FIG. 1.

The invention is capable of embodiment in various forms. One general arrangement is depicted in FIG. 3. A specific preferred form is illustrated in FIGS. 1 and 4.

Figure 1:
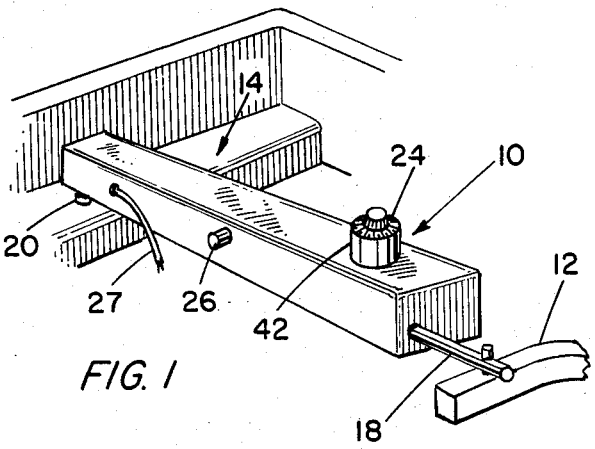
FIG. 1 is an isometric view of a preferred form of automatic steering controller for boats according to the invention.

In FIG. 1, the controller 10 is shown mounted in the stern of a boat connected between a tiller 12 and a seat 14 which is fixed to the hull. The controller's components are enclosed in a housing 16 which serves as a frame on which the several components are mounted. One of the components is a rod 18. It extends from one end of the housing in a degree that varies during operation for it is a "travelling nut" and is connected at its outer end to the tiller 12. The housing carries a pin 20 at its opposite end by which it is connected pivotally to seat 14.

The error sensing structure in the preferred embodiment includes a compass card and optical coupler which are housed in a compass cage 22 which, in this case, is mounted atop the housing. The optical coupler is mounted for rotation with an inner housing which may be turned by turning the knob and dial combination 24.

Sensitivity of the sensor system varies with light intensity. In this case, intensity is varied by a variable resistor whose adjustment knob 26 is visible at the side of housing 16. Power for the unit is supplied from a source by power line 27.

Figure 2:
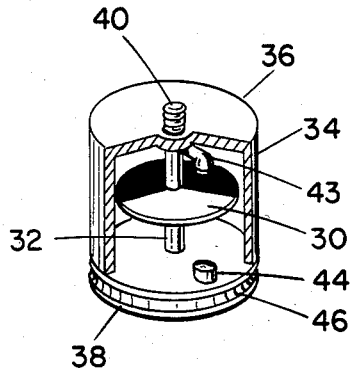
FIG. 2 is an isometric view of a portion of the compass and sensor unit of the controller of FIG. 1.

A variety of error sensors are useful and may be incorporated in controllers which embody the invention. In the preferred forms, the error signal is furnished to the error sensor as a mechanical input, preferably as a position. Such a sensor is shown in FIG. 2. A compass card 30 is mounted for rotation about a spindle 32. The spindle is mounted on the axis of a cylindrical housing 34 between its ends 36 and 38. A portion of the side wall and end 36 are broken away to expose the interior. The shaft 40 at end 36 extends through an outer cylindrical cup 42, shown in FIG. 1, to a connection, to a knob and dial by which the structure of FIG. 2 may be rotated relative to the outer cup. The knob and dial 24 and the cup are visible in FIG. 1.

The compass card in this model has one portion of its surface which is opaque and another portion which is transparent. An optical coupler includes a light source 43 and a light sensitive diode 44 arranged such that light from the source will cause a change in electrical conduction in the light sensitive diode. There is no gradation in reflectivity in this preferred embodiment, but the invention is applicable to steering units which incorporate that feature.

At its lower end 38, the margin of the housing 34 is grooved to form a pulley 46 by which the compass housing 34 may be rotated relative to cup 42 and system housing 16.

For convenience, and to facilitate description, the error sensor of FIG. 3 employs the elements shown in FIGS. 1 and 2. Although other error sensors may be employed, this one is preferred. The direction sensing element 50 corresponds to compass card 30. compass housing 34, and the optical coupler which, in FIG. 3, is shown to comprise a light source 43 and a light sensitive cell 44. The differential amplifier 56 is connected across cell 44.

The output of the amplifier is reversed when the optical coupler is passed from a position over the opaque to a position over the clear portion of the compass card and vice versa. The motor 60 is reversible, and its direction is determined by which side of the dividing line between opaque and transparent areas of the card the sensor overlies.

In one variation of the error sensor, one area of the compass card is opaque or translucent and the other is translucent or transparent, respectively. In that case, returning to FIG. 2, light from the upper source 43 activates the sensor in coupler 44. Of course, the positions of the light source and light sensor may be reversed.

In FIG. 3, motor 60 rotates a drive screw 64 which is threadedly engaged in a rudder positioner or rudder moving element which in this case is a travelling nut 66. The nut is formed as an elongated tube. A pin 68 at the end of the tube engages the tiller 70 of rudder 72. The latter pivots on pivot pin 74. Many boats that use autopilots also use rudder shafts without pintles and gudgeons. The invention, of course, is equally applicable to such an arrangement.

Two forces operate to alter the relative rotational position of the compass card 30 and the sensor 44. The rotational position of the card is controlled by the earth's magnetism and so remains fixed. A change in the boat's heading operates to rotate the compass cage or housing 34 and the sensor around the card. That input is represented in FIG. 3 by the dotted line vessel 76 and the line 78 which connects the vessel and cage 34.

The other force that operates to reposition the sensor is a feedback connection represented by dotted line 80 which operates to rotate the cage or housing 34 as an incident to rotation of motor 60. In this case, the actual connection extends from travelling nut to housing 34. This connection includes a means for altering the feedback factor, the ratio of the degree of movement of the output element, the travelling nut 66, to the degree of movement of the sensor 44. That means is represented by the box 82 labelled SCALE CHANGER in FIG. 3. The actual structure may be electrical or mechanical in a broader view of the invention. However, special advantages arise out of use of a lever system to effect scale change. A lever system of preferred form is shown in FIG. 4.

The controller of FIG. 4 is the one that is depicted in FIG. 1 and portions of the housing 16 are shown to illustrate that the housing serves as a frame. The error sensor is the one shown in FIG. 2. The compass card 30, the light source and sensor 43 and 44, and the pulley portion 46 of the compass housing are shown. As in FIG. 3, a reversible motor 100 is driven by an electrical amplifier 102. The motor turns a drive screw 104. The screw drives an elongated travelling nut 18 whose outer end is pivoted on a pin 106 to the tiller arm 12. The electrical connections between the amplifier 102 and the sensor apparatus 44 is represented by dashed line 108.

The structure by which the position of the output element is fed back to the error detector includes a lever 110 which, in this model, is mounted on frame 16 for pivotal motion about a pivot point 112 at one end. The lever is biased for counter-clockwise rotation away from the error detection elements 30, 44 and 46 by a tension spring 114. The spring is stretched between a point 116 on the frame 16 and a point 118 on the lever.

A means is provided for connecting the output member of the servo-mechanism, the travelling nut 18, to a selected point of one of several possible points on the lever 110. In this preferred form, a pliant belt 120, which may be a line or a cable or the like, extends from a bracket 122 carried by nut 18 to one reel 124 of a set of two reels which are fixed together and mounted for rotation together on frame 16. Another line or cable 126 is attached by a hook 128 to lever 110 at hook hole 130. The opposite end of cable 126 is wound on reel 132 of the reel set.

Rotation of motor 100 in a direction to move the travelling nut 18 away from the motor reduces the tension in line or cable 120 which tends to become slack. That tendency to slack is taken up in spring 114. The latter urges lever 110 to counter-clockwise motion pulling on cable 126 and rotating reel 132 and, therefore, reel 124 to take up line 120. Conversely, rotation of motor 100 to move nut 18 toward the motor applies tension to cable 120. Reel 124 rotates to pay out cable 120. Cable 126, being wound oppositely on reel 132, is taken up pulling the lever 110 to clockwise rotation and stretching spring 114.

The ratio of nut 18 movement to hook 128 movement is fixed because the circumferences of the two reels is fixed. On the other hand, the ratio of hook 136 movement to hook 128 movement is easily changed by moving one or both of hooks 128 and 136 to others of the holes in lever 110. In most cases, it is hook 136 that is moved, and it can be moved with ease at the time of sail and even when under way.

The lever 110 is arranged so that cable 126 and another cable 134 may be connected at any of a number of points on the lever. In this case, that is accomplished by forming a number of holes in the lever which can accommodate hook 128 at the end of cable 126 and hook 136 at the end of cable 134. The several holes are spaced such that the lever arm between the pivot point 112 and the hole is different from the lever arm from point 112 to hole 140 where hook 136 is connected. The lever arm from hole 130 to pivot point 112 is greater than the lever arm from hole 140 to point 112. Thus, the degree of movement of hook 136 is less for a given degree of movement of travelling nut 18 than is the movement of hook 128. Furthermore, the degree of movement of hook 128 is less than the movement of bracket 122 and nut 18 because the reel 124 has greater circumference than does reel 132.

Cable 134 is threaded around pulley 46 and its end opposite hook 136 is fixed to one end of an extension spring 142 whose other end is fixed to the frame 16 at post 144. In FIG. 4, the cable 134 extends around the pulley counter-clockwise from hook 136. Movement of travelling nut 18 away from motor 100 will result in counterclockwise pivoting of lever 110 and clockwise rotation, from the top, of pulley 46 and sensor 44. Returning to FIG. 1, the controller is shown to be pivotally connected to the seat at the starboard side of the boat. Outward movement of the nut turns the rudder to starboard. If the controller were reversed and connected between the tiller and the port side of the boat, outward movement of the nut would apply port rudder.

To correct that error, it is required only to reverse the direction of cable 134 on pulley 46. Instead of being wrapped counter-clockwise from the hook, it need only be wrapped clockwise.

In FIG. 1, the desired course is set by rotating the knob and dial 24 to an angular position relative to the dividing line between clear and opaque areas of the compass card. The angle of rotation corresponds to the angle which the desired course makes with magnetic north. Inspection of FIGS. 2 and 4 will make it clear that rotation of knob and dial 24 of FIG. 1 results in corresponding rotation of pulley 46 in FIG. 4. When the pulley is rotated manually in that fashion, the cable 134 slides over the pulley surface. Thus, the arrangement shown makes it a simple matter to set a desired course.

Scale changing to alter the degree of feedback is accomplished at two points in FIG. 4. A fixed amount of reduction is introduced at the reel set 124 and 132. Only the adjustable portion is accomplished at the lever. As a consequence, shorter lever arm differences are required to accomplish the scale change, finer and more accurate adjustment is possible, and, by changing the position of hook 128, the scale can be either increased or decreased with the lever.

Although I have shown and described certain specific embodiments of my invention, I am fully aware that many modifications thereof are possible. My invention, therefore, is not to be restricted except insofar as is necessitated by the prior art.

I claim:

1. For connection to a boat rudder:

a rudder moving element;

heading error signal generating means including a feedback element movable in proportion to movement of said rudder moving element position for providing a signal indicative of the direction of heading error;

steering control means responsive to said signal for moving said rudder moving element and said feedback element in directions determined by said signal;

scale changing means for adjusting the degree of such movement of said feedback element relative to the degree of such movement of said rudder moving element;

said scale changing means comprising a lever movable as an incident to movement of said rudder moving element and to which said feedback element is connected for movement;

said feedback element being rotatable and including a rotatable drive element, said scale changing means comprising a cable having connection to a point on said lever and extending over said drive element whereby said feedback element is rotated as an incident to movement of said lever; and further comprising a spring connected to said lever to tend to bias the lever to rotation in one direction and means in the form of a cable interconnecting said rudder moving element and said lever on a selected point on said lever for moving the lever in opposition to said bias, and in yielding to said bias, in a degree that is proportional to movement of said rudder moving element.

2. In a steering system for boats:

a frame;

a compass element mounted for rotation on said frame;

a sensor mounted for rotation relative to said compass element and said frame and effective to provide a signal indicating whether the sensor is at one side or the other of a selected part of said compass element;

a rudder moving element;

ratio adjusting means responsive to said signal for moving said rudder moving element and for rotationally moving said sensor relative to said frame;

scale changing means for selectively altering the relative degree of movement of said rudder moving element and said sensor in response to said signal;

said ratio adjusting means comprising a lever mounted to pivot on said frame;

first means connecting the rudder moving element to one point on the lever such that the lever is pivoted as an incident to movement of the rudder moving element;

second means connecting another point on said lever to said sensor such that the sensor is moved rotationally as an incident to pivoting of the lever;

said second means being adjustable to reverse the direction of rotational movement of said sensor as an incident to pivotal movement of the lever in one direction;

said scale changing means comprising means for selectively changing the point at which at least one of said first and second means is connected to said lever; and said first means comprising a cable interconnecting said rudder moving element and said lever and further comprising a spring connected to said lever and effective to hold said cable taut.

* * * * *